United States Patent [19]

Hartley

[11] Patent Number: 4,610,605

[45] Date of Patent: Sep. 9, 1986

[54] TRIPLE DISCHARGE PUMP

[75] Inventor: E. Dale Hartley, Malibu, Calif.

[73] Assignee: Product Research and Development, Anaheim, Calif.

[21] Appl. No.: 748,484

[22] Filed: Jun. 25, 1985

[51] Int. Cl.[4] ..... F04B 1/18; F04B 43/00; F01B 19/00

[52] U.S. Cl. ..... 417/269; 417/566; 92/48; 92/100

[58] Field of Search ..... 417/269, 566; 92/48, 92/100

[56] References Cited

U.S. PATENT DOCUMENTS

| | | | |
|---|---|---|---|
| 2,797,647 | 7/1957 | Floraday | 417/566 |
| 2,931,311 | 4/1960 | Ulm et al. | 92/100 |
| 2,991,723 | 7/1961 | Zubaty | 92/48 |
| 3,010,403 | 11/1961 | Zubaty | 92/48 |
| 4,153,391 | 5/1979 | Hartley | 417/269 |
| 4,396,357 | 8/1983 | Hartley | 417/269 |
| 4,515,531 | 5/1985 | Roser | 417/269 |

*Primary Examiner*—William L. Freeh
*Attorney, Agent, or Firm*—Gordon L. Peterson

[57] ABSTRACT

A pump comprising a housing and a flexible diaphragm mounted in the housing. A first region of the diaphragm partially defines a first pumping chamber, and the pumping chamber has an inlet and an outlet. A wobble plate drive is coupled to the first region of the diaphragm to provide a pumping action in the pumping chamber. The wobble plate drive has a nutating axis, and the first region of the diaphragm lies radially outwardly of the nutating axis. The first region of the diaphragm has a generally annular ramp section which flexes when driven by the wobble plate drive to provide the pumping action, and the ramp section is wider radially at a location remote from the nutating axis than at a location nearer the nutating axis. The pump also has a single outlet valve arranged to serve multiple pumping chambers.

19 Claims, 8 Drawing Figures

13
11
35
29
25
19
17
2
30
15
27
2
23
21

71
35
75
29
63
61
83
59
89
27
25
13
81
65
87
84
49
37
73
23
88
74
86
101
79
39
85
41
75
43
109
95
53
51
21
103
55
99
97
47
105
31
33
45
91
57
107
69
67
30

TRIPLE DISCHARGE PUMP

BACKGROUND OF THE INVENTION

Diaphragm pumps possess many advantages and are widely used. When a reciprocating drive is used for a diaphragm pump, a dished diaphragm can be used to accommodate linear reciprocating motion. As its name implies, a dished diaphragm has a dished section in the form of a frustum of a right circular cone to accommodate the reciprocating motion.

A nutating or wobble plate drive can also be used to drive a diaphragm pump, and one such construction is shown in my U.S. Pat. No. 4,153,391. Although a wobble plate drive provides a type of back and forth motion, it is quite different from linear reciprocation.

A conventional dished diaphragm is not suitable for use with a wobble plate drive. When they are used together, volumetric efficiency decreases, and diaphragm wear increases. This is caused by the fact that the nutating motion is larger at radial outer regions of the diaphragm than at radial inner regions of the diaphragm. Accordingly, the dished section at the radial inner regions of the driven portion of the diaphragm is too large and is free to be drawn into the pumping chamber on the intake stroke to reduce the volume of the pumping chamber and is forced in the other direction on the discharge stroke. The repeated flexing of the diaphragm in this manner accelerates wear on the diaphragm, and bulging of the diaphragm into the pumping chamber on the intake stroke reduces the volumetric efficiency.

There are a variety of wobble plate drives for diaphragm pumps as shown by my U.S. Pat. Nos. 4,153,391 and 4,396,357. Although these wobble plate drives function satisfactorily, production problems can arise due to a build up of tolerances from the various parts of the drive.

As shown by my U.S. Pat. No. 4,153,391, it is common practice to provide a separate output valve for each of the pumping chambers of a diaphragm pump. Although separate outlet valves function satisfactorily, they increase the cost of the pump somewhat, and this is significant in the crowded and highly developed pumping field.

SUMMARY OF THE INVENTION

This invention provides a wobble plate diaphragm pump with improved volumetric efficiency and reduced diaphragm wear. In addition, the accumulation of tolerances for the wobble plate drive is reduced. The pump is also simplified, and its cost is reduced by utilizing a single outlet valve for multiple pumping chambers.

According to one feature of this invention, the region of the diaphragm coupled to the wobble plate drive has a generally annular ramp section which flexes when driven by the wobble plate drive to provide a pumping action in a first pumping chamber. With this feature of the invention, the ramp section of the diaphragm is matched, or partially matched, with the nutating motion of the wobble plate. This is accomplished by making the ramp section wider radially at a location remote from the nutating axis than at a location nearer the nutating axis. Preferably, the ramp section progressively widens radially as it extends radially outwardly of the nutating axis. Such a ramp section can be formed, for example, by a particular segment of a cone. By matching of the ramp shape to the nutating motion, volumetric efficiency is improved and wear is reduced.

The wobble plate drive includes a piston section coupled to a region of the diaphragm. Another feature of this invention is that the diaphragm includes means along the periphery of the piston section for reducing the likelihood of contact between the periphery and other portions of the pump. Such means, which may be in the form of a continuous or segmented guard ridge surrounding the piston section, reduces or eliminates the noise that would exist from contact between the relatively hard piston section and adjacent regions of the pump. The diaphragm may also advantageously include an integral ridge at least partially defining a seal for sealing between adjacent pumping chambers.

To minimize an accumulation of tolerances for the wobble plate drive, the drive preferably includes an integral wobble plate having an integral piston section coupled to the diaphragm to drive the latter and provide the pumping action. By making the piston integral with the wobble plate, tolerance buildup is reduced as compared to the conventional separate piston and separate wobble plate. The integral wobble plate and piston section construction also help keep the intersection of the nutating axis and the motor shaft axis at the diaphragm which further minimizes fatigue of the diaphragm. Finally, the integral construction is stronger than the two-piece construction.

Another feature of this invention is the use of a single outlet valve for controlling flow through the outlets of multiple pumping chambers into a common outlet chamber. A primary difficulty with using a single outlet valve is in sealing between the outlets when one of the outlets is opened by the outlet valve.

According to this feature of the invention, the pump includes a valve plate mounted in a pump housing, and each of the outlets extends through the valve plate. The outlet valve is carried by the valve plate and has a resilient section which comprises a plurality of resilient portions which cover the outlets, respectively. With this construction, each of the pumping chambers can force the fluid therein to force the associated resilient portion to uncover the associated outlet to allow discharge of the fluid therefrom. Means is provided on the outlet valve and the valve plate for sealing between the outlets even when one of the outlets is opened by the outlet valve.

To assist in enabling the outlet valve to hold the other outlets closed when one of them is open, means is preferably provided for stiffening the resilient section between adjacent outlets. To further help seal between adjacent outlets, a slot can be provided in the valve plate between two adjacent outlets, and a web carried by the outlet valve is partially received in the slot. The stiffening means may include the web, which may also extend in both directions from the resilient section. In a preferred construction, the outlet valve includes a central mounting portion for mounting the outlet valve in the valve plate, and the resilient section surrounds the central mounting portion. Preferably, the resilient section is concave and is received in a concave recess in the valve plate.

Although the various features of this invention can be used singly or in any combination, they are preferably used together. The invention, together with additional features and advantages thereof, may best be understood by reference to the following description taken in connection with the accompanying illustrative drawing.

DESCRIPTION OF THE PREFERRED EMBODIMENT

Figure 1:
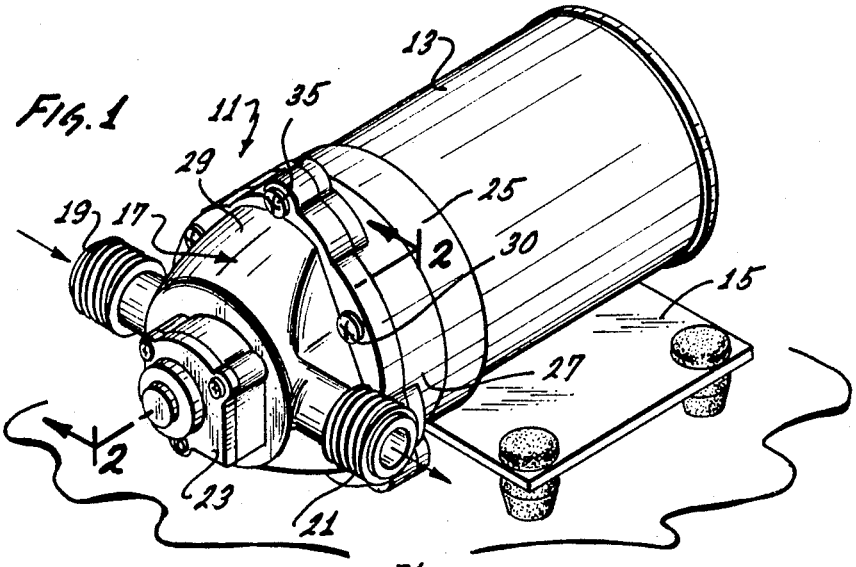
FIG. 1 is an isometric view of a pump constructed in accordance with the teachings of this invention.

FIG. 1 shows a pump 11 and an associated electric motor 13 mounted on a suitable base 15. As shown in FIG. 1, the pump 11 has a housing 17, an inlet 19, an outlet 21 and a pressure switch 23 mounted on the housing. The pressure switch 23 operates the pump 11 as a demand pump in that it turns the motor 13 on to drive the pump when discharge pressure falls below a predetermined level and turns the motor 13 off when the discharge pressure rises above a predetermined upper level.

Figure 2:
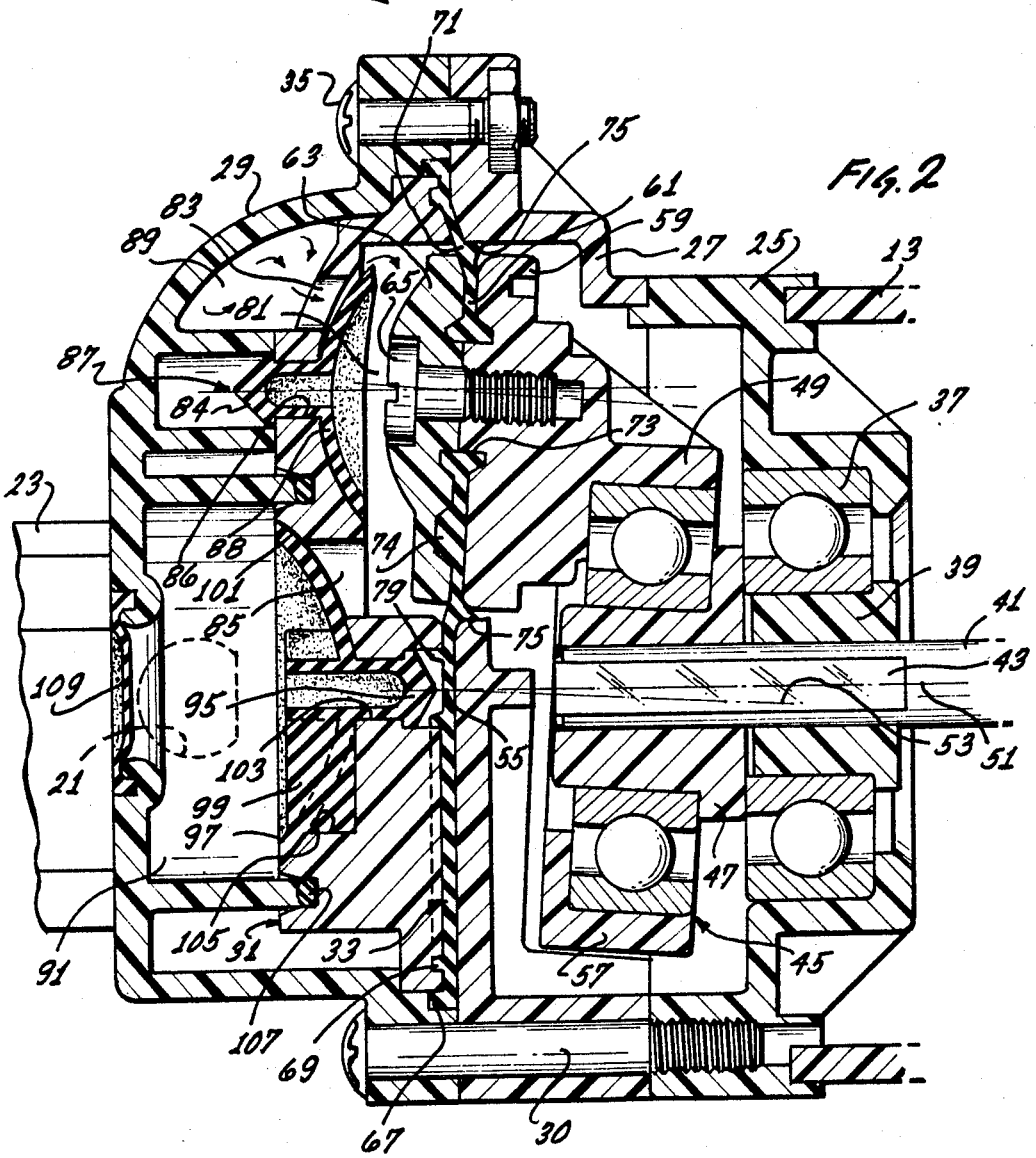
FIG. 2 is a fragmentary sectional view taken generally along line 2—2 of FIG. 1 showing one of the pumping chambers at the end of its intake stroke.
Figure 3:
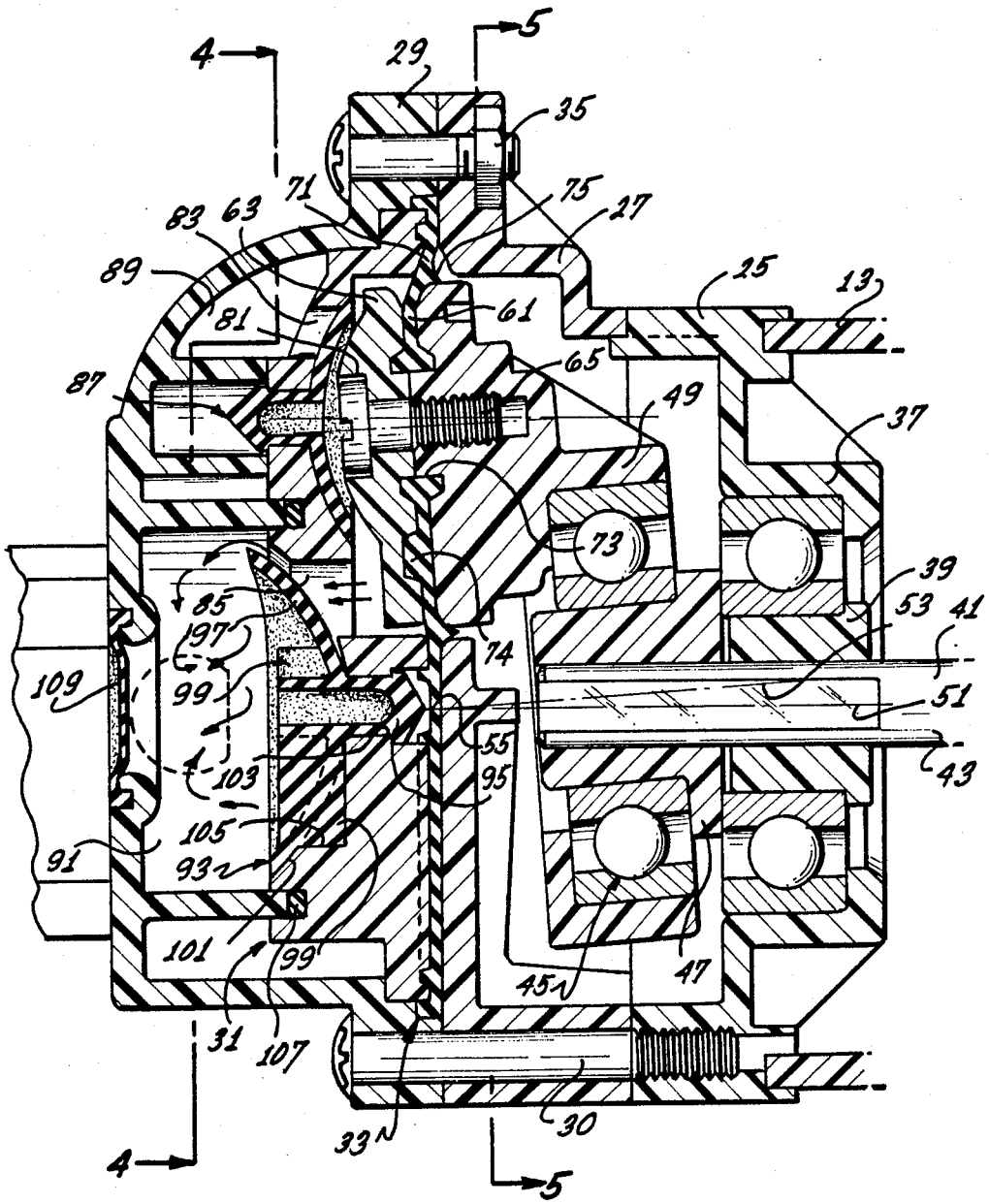
FIG. 3 is a sectional view similar to FIG. 2, with the illustrated pumping chamber completing its discharge stroke.
Figure 4:
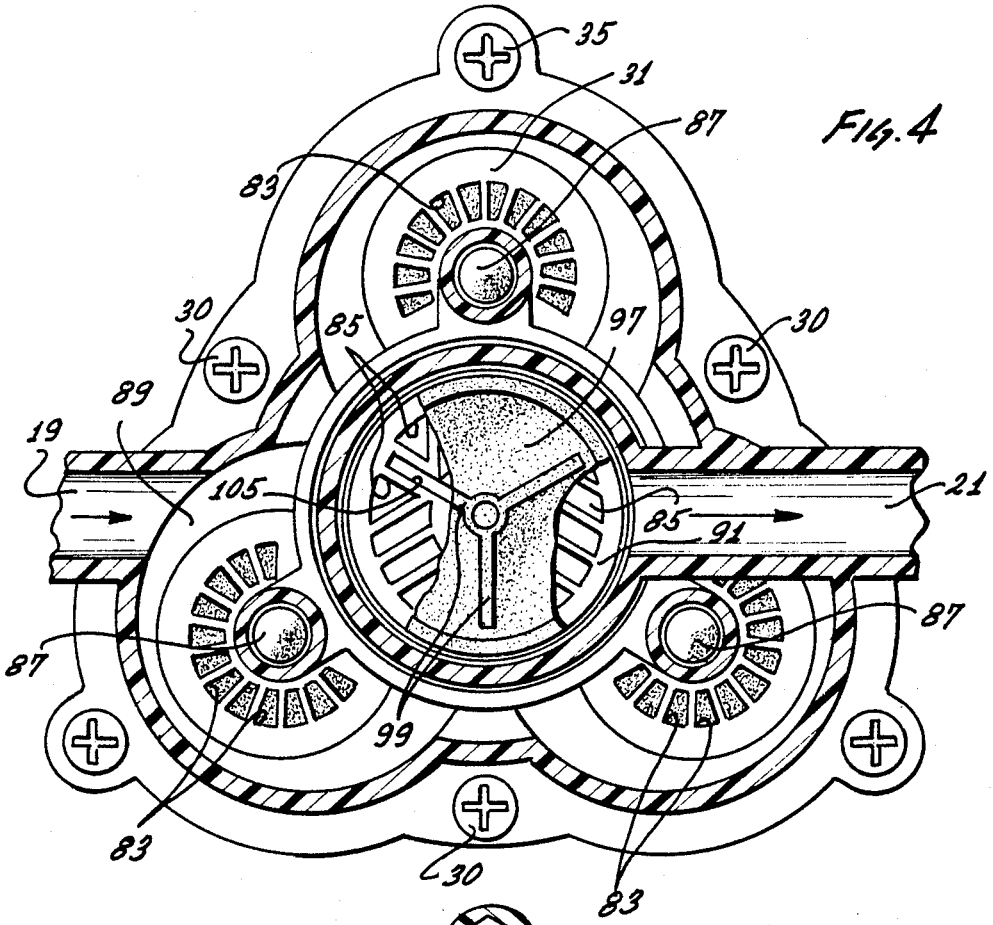
FIGS. 4 and 5 are sectional views taken generally along lines 4—4 and 5—5, respectively, of FIG. 3.
Figure 5:
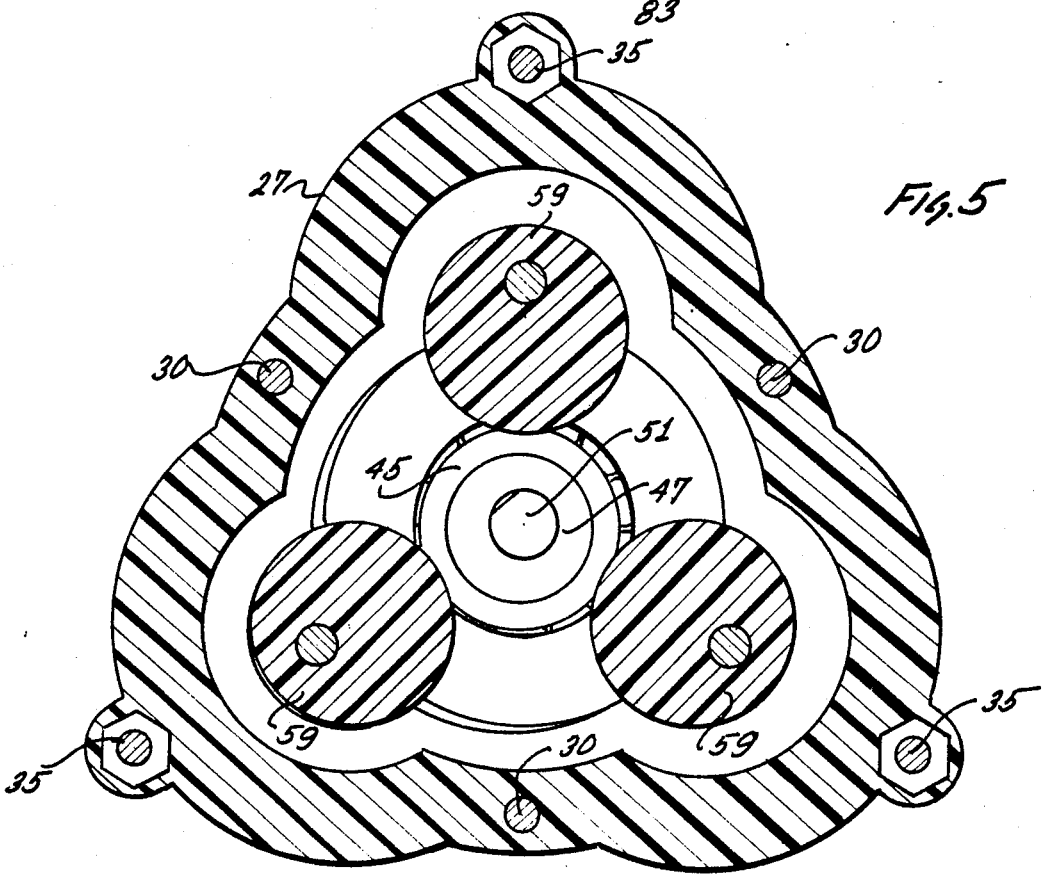

The housing 17, which may be of any suitable construction, in this embodiment includes a housing section 25 (FIG. 2) which may be coupled to the motor housing, an intermediate housing section 27 and a housing section 29. The housing section 25 can be joined to the housing section 27 and 29 by a plurality of fasteners 30 (FIGS. 1–5). A valve plate 31 and a diaphragm 33 have their peripheral regions clamped between the housing sections 27 and 29, the latter being held together by fasteners 35 (FIGS. 2, 3 and 5). The diaphragm 33 extends completely across the interior of the housing 17 and partitions the housing interior. The housing sections 25, 27 and 29 and the valve plate 31 may be integrally molded from a suitable plastic material.

As shown in FIGS. 2 and 3, an outer ball bearing 37 is mounted in the housing section 25 and receives a bushing 39 which in turn is drivingly coupled to an output shaft 41 of the motor 13 by virtue of a flat 43 on the shaft and a corresponding flat (not shown) on the bushing 39. An inner ball bearing 45 is mounted on the motor shaft 41 by an eccentric bushing 47. A wobble plate 49 is mounted on the outer race of the ball bearing 45. With this construction, the inner race of the bearing 37, the bushing 39 and the motor shaft 41 rotate about an axis 51, which is coaxial with the motor shaft, and the eccentric bushing 47 and the inner race of the ball bearing 45 rotate about a nutating axis 53. The axes 51 and 53 intersect at a point 55 in the plane of the diaphragm 33 in all rotational positions.

The bearings 37 and 45, the bushings 39 and 47 and the wobble plate 49 form a wobble plate drive. With this construction, the wobble plate 49 is subjected to nutating motion.

The wobble plate 49 includes a mounting section 57 which surrounds the outer race of the bearing 45 to mount the wobble plate on the bearing and three piston sections 59 (FIG. 2 and 5). The wobble plate 49 is of one-piece, integral construction and may be integrally molded of a suitable plastic material.

The piston sections 59 are coupled, respectively, to three separate regions 61, 61*a* and 61*b* (FIGS. 2, 3 and 6), respectively, and this is accomplished by clamping such regions between a diaphragm retainer 63 attached to the associated piston section 59 by a screw 65. The regions 61, 61*a* and 61*b* are preferably identical and are joined to the associated piston sections 59 in the same manner as shown in FIGS. 2 and 3.

Figure 8:
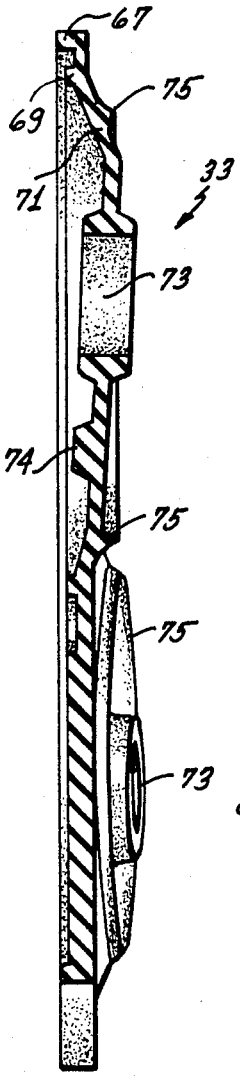
FIG. 8 is a sectional view taken generally along line 8—8 of FIG. 6.
Figure 6:
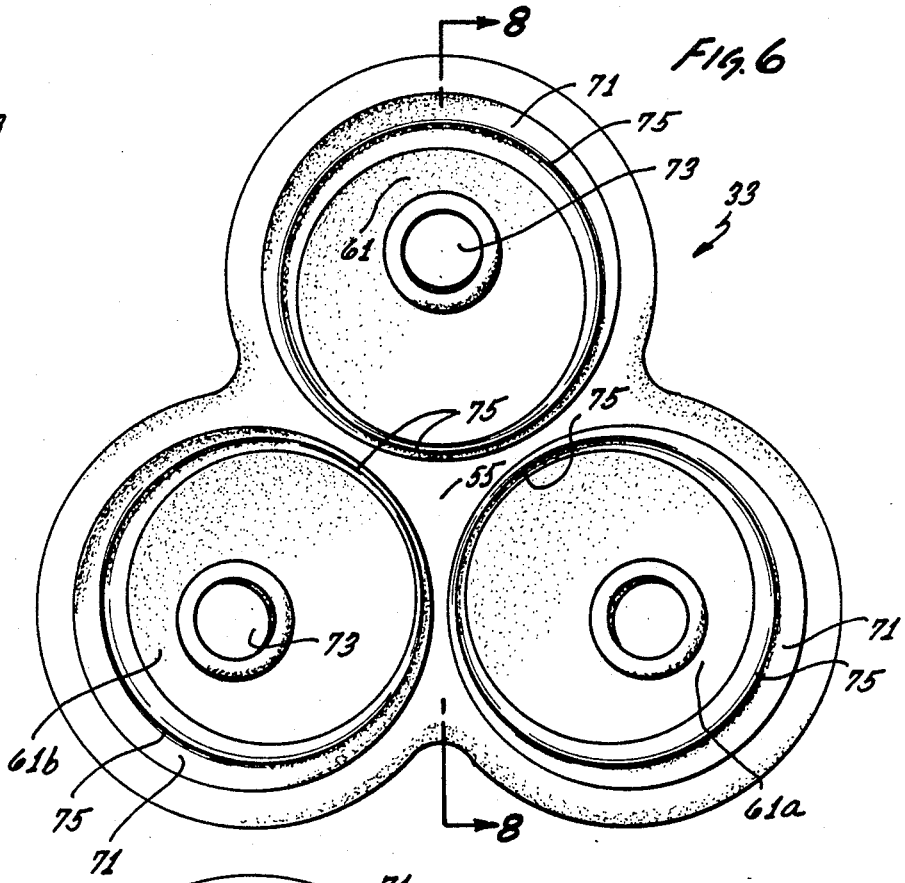
FIG. 6 is a bottom plan view of a preferred form of diaphragm.
Figure 7:
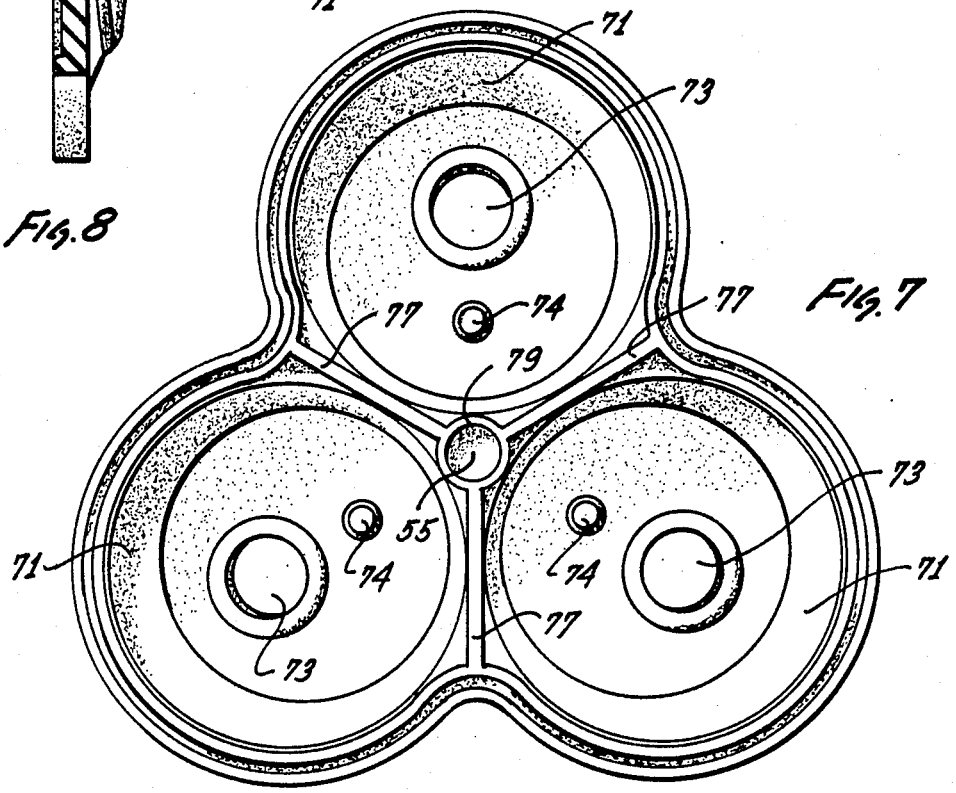
FIG. 7 is a top plan view of the diaphragm.

The preferred construction for the flexible diaphragm 33 is shown in FIGS. 6–8. The diaphragm 33 has peripheral ribs 67 and 69 for sealingly engaging the housing section 29 and the valve plate 31, respectively, and each of the regions 61 has an annular ramp section 71 which flexes when driven by the wobble plate drive to provide a pumping action. Each of the ramp sections 71 progressively widens radially as it extends radially outwardly of the point 55 where the nutating axis 53 intersects the axis 51. In this embodiment, each of the ramp sections 71 defines a segment of a cone which is defined by passing a plane through a cone nonperpendicular to the altitude of the cone.

Each of the regions 61, 61*a* and 61*b* has a central opening 73 for receiving portions of the piston section 59 and the retainer 63 and an indexing projection 74 for orienting the retainer 63. A generally annular guard ridge 75 extends along one side of the ramp section 71 for the purpose of isolating the periphery of the piston section 59 from the housing section 27. The diaphragm 33 has integral ridges 77 for defining a seal for sealing between the regions 61, 61*a* and 61*b*. In addition, the diaphragm 33 has an annular ridge 79 which also provides a portion of the seal between the regions 61, 61*a* and 61*b*. The diaphragm 33 may be constructed of a suitable rubber.

As shown in FIG. 2, the region 61 of the diaphragm 33 cooperates with the valve plate 31, the piston section 59, the retainer 63 and the screw 65 to define a pumping chamber 81. The other regions 61*a* and 61*b* of the diaphragm 33 cooperate similarly with corresponding structure to define two other identical pumping chambers. The pumping chamber 81 has an inlet 83 (FIGS. 2–4) extending through the valve plate 31 and an outlet 85 which also extends through the valve plate. One resilient inlet valve 87 is mounted on the valve plate 31 for each of the pumping chambers 81 and is adapted to overlie an associated inlet 83. Each of the inlet valves 87 may be of conventional construction and include a central mounting portion 84 received in a bore 86 of the valve plate 31 and a resilient section 88. The inlets 83 communicate with a common inlet chamber 89 which leads to the inlet 19. The outlets 85 lead to a common outlet chamber 91 which is in communication with the outlet 21.

A common outlet valve 93 of one-piece integral construction is carried by the valve plate 31 and may be molded from a suitable material, such as rubber. The outlet valve 93 has a central, generally cylindrical mounting portion 95 for mounting the valve on the valve plate and a concave, part-spherical, resilient section 97 surrounding the central mounting portion. The outlet valve 93 also has three radially extending webs 99 spaced apart 120 degrees and extending in both axial directions from the resilient section 97.

The valve plate 31 has a generally concave recess 101 for receiving the concave, resilient section 97, and the mounting portion 95 extends through a bore 103 in the valve plate 31. The valve plate 31 also has three slots 105 (FIGS. 2–4) which extend radially between the outlets 85 of adjacent pumping chambers 81. Regions of the webs 99 on the convex side of the resilient section 97 are received within the slots 105, respectively. With this arrangement, resilient portions of the resilient section 97 cover the outlets 85 of the three pumping chambers 81, respectively. These resilient portions would lie between adjacent webs 99 and lift off the associated outlet 85 as shown in FIG. 3; however, the webs 99 locally stiffen the outlet valve 93 so that the outlet valve can seal the other outlets 85 from the other pumping chambers 81 when one of the pumping chambers is discharging liquid through its associated outlet into the outlet chamber 91. In addition, the portions of the web 99 that are received in the slots 105 cooperate with the slots 105 to further tend to provide a seal between adjacent pumping chambers. In this regard, the webs 99 may be received in the associated slots 105 with some looseness or a friction fit. In this manner, a single outlet valve 93 controls outlet flow from multiple pumping chambers into a common outlet chamber.

As shown in FIGS. 2 and 3, the outlet chamber 91 can be sealed to the valve plate 31 by an O-ring seal 107. A diaphragm 109 isolates the pressure switch 23 from the fluid in the outlet chamber 91.

Although the pump 11 is adapted to pump various fluids, it is particularly adapted for the pumping of water. If the pressure in the outlet chamber 91 is below a predetermined lower level, the pressure switch 23 closes a circuit to the motor 13 to bring about rotation of the shaft 41, and nutating motion of the wobble plate 49 and the piston sections 59. This nutating motion periodically flexes the regions 61, 61*a* and 61*b* of the diaphragm 33 to provide a nutating pumping action in each of the pumping chambers 81. The ramp sections 71 allow the nutating pumping motion to occur, and the ramp sections 71 are tailored to the nutating motion of the piston sections 59. Thus, the ramp sections 71 are narrower radially at radial inward locations than at radial outward locations. With this arrangement, there is no excess or unsupported length of the ramp section 71 which can be drawn into the pumping chambers 81 during the intake stroke shown in FIG. 2 or be forced in the other direction on the discharge stroke shown in FIG. 3. Accordingly, volumetric efficiency is improved, and wear on the diaphragm 33 is reduced.

On the intake stroke in each pumping chamber, the pressure reduction in the pumping chamber allows to allow the liquid in the inlet chamber 89 to open the inlet valve 87 as shown in FIG. 2 and flow into the pumping chamber. On the discharge stroke, the pressure in the pumping chamber 81 increases over what it is in the outlet chamber 91 so as to force the associated portion of the resilient section 97 away from the outlet 85. The outlet valve 93 cooperates with the valve plate 31 as described above to seal the other outlets 85 from the outlet 85 which is opened.

The one-piece wobble plate 49 minimizes a build up of tolerances for the wobble plate drive and increases the strength of the wobble plate and piston sections. In addition, the integral wobble plate helps keep the point 55 at the diaphragm 33 to minimize fatigue of the diaphragm.

Although an exemplary embodiment of the invention has been shown and described, many changes, modifications and substitutions may be made by one having ordinary skill in the art without necessarily departing from the spirit and scope of this invention.

I claim:

1. A pump comprising:

a housing;

a flexible diaphragm mounted in said housing;

means cooperating with a first region of the diaphragm to define a first pumping chamber, said pumping chamber having an inlet and an outlet;

a wobble plate drive at least partially in said housing and subject to nutating motion, said wobble plate drive being drivingly coupled to said first region of the diaphragm to provide a pumping action in said first pumping chamber;

said wobble plate drive having a nutating axis and said first region of the diaphragm lying radially outwardly of the nutating axis;

said first region of said diaphragm having a generally annular ramp section which flexes when driven by the wobble plate drive to provide said pumping action in the first pumping chamber; and said ramp section when unstressed by any external member being wider radially at a location remote from the nutating axis than at a location nearer the nutating axis.

2. A pump as defined in claim 1 wherein said ramp section progressively widens radially as it extends radially outwardly of the nutating axis.

3. A pump as defined in claim 2 wherein said ramp section defines a segment of a cone which is defined by passing a plane through a cone nonperpendicular to the altitude of the cone.

4. A pump as defined in claim 1 wherein said wobble plate drive includes a piston section coupled to said first region of the diaphragm and said diaphragm includes means along the periphery of the piston section for reducing the likelihood of contact between said periphery and other portions of the pump.

5. A pump as defined in claim 4 wherein said means on said diaphragm includes a guard ridge surrounding the piston section.

6. A pump as defined in claim 4 wherein said ramp section progressively widens radially as it extends radially outwardly of the nutating axis.

7. A pump as defined in claim 1 including means cooperating with a second region of the diaphragm to define a second pumping chamber, said pumping chamber having an inlet and an outlet, said second region of said diaphragm having a generally annular ramp section which flexes when driven by the wobble plate drive to provide said pumping action in the second pumping chamber.

8. A pump as defined in claim 7 wherein said diaphragm includes an integral ridge at least partially defining a seal for sealing between said first and second pumping chambers.

9. A pump as defined in claim 1 wherein the wobble plate drive is adapted to be driven by a motor shaft and said wobble plate drive includes a first bearing, means for mounting the first bearing for rotation about an axis which is inclined relative to the axis of the motor shaft and an integral wobble plate mounted on said first bearing, said wobble plate including an integral piston section coupled to said first region of said diaphragm to drive the latter and provide said pumping action in said first pumping chamber.

10. A pump as defined in claim 1 including means cooperating with a second region of the diaphragm to define a second pumping chamber, said pumping chamber having an inlet and an outlet, said pump including a valve plate mounted in said housing and having each of said outlets extending through said valve plate and a resilient outlet valve carried by said valve plate and having a resilient section comprising a plurality of resilient portions covering said outlets, respectively, whereby each of the pumping chambers can force the fluid therein to force the associated resilient portion to uncover the associated outlet to allow discharge of the fluid therefrom, and means on the outlet valve and the valve plate for sealing between said outlets even when one of said outlets is opened by said outlet valve.

11. A pump as defined in claim 10 wherein said sealing means includes means for stiffening the resilient section of the outlet valve between adjacent outlets.

12. A pump as defined in claim 10 wherein said sealing means includes a slot in the valve plate between two adjacent outlets and a web carried by the outlet valve and received in said slot.

13. A pump as defined in claim 14 wherein said web extends in both directions from the resilient section and stiffens the resilient section between the two adjacent outlets.

14. A pump as defined in claim 10 wherein said outlet valve includes a central mounting portion for mounting the outlet valve on the valve plate, said resilient section surrounds the central mounting portion and said sealing means includes a slot in the valve plate between two adjacent outlets and a web carried by the outlet valve and partly received in said slot and said web extends in both directions from the resilient section and stiffens the resilient section between two adjacent outlets.

15. A pump as defined in claim 14 wherein said resilient section is concave and is received in a concave recess in said valve plate, and said outlets extend through the valve plate at said concave recess.

16. A pump comprising:

a housing;

a flexible diaphragm mounted in said housing;

means cooperating with a first region of the diaphragm to define a first pumping chamber, said pumping chamber having an inlet and an outlet;

a wobble plate drive at least partially in said housing and subject to nutating motion, said wobble plate drive being drivingly coupled to said first region of the diaphragm to provide a pumping action in said first pumping chamber;

said wobble plate drive having a nutating axis and said first region of the diaphragm lying radially outwardly of the nutating axis;

said first region of said diaphragm having a generally annular ramp section which flexes when driven by the wobble plate drive to provide said pumping action in the first pumping chamber; and said ramp section being constructed so that it is wider radially at a location remote from the nutating axis than at a location nearer the nutating axis.

17. A pump as defined in claim 16 wherein said ramp section progressively widens radially as it extends radially outwardly of the nutating axis.

18. A pump as defined in claim 16 including a piston section joined to said first region for use in drivingly coupling the wobble plate to said first region.

19. A pump as defined in claim 16 wherein the configuration of the ramp section is substantially matched to the nutating motion of the wobble plate drive.

* * * * *